US012550929B2

(12) United States Patent
Rogan

(10) Patent No.: US 12,550,929 B2
(45) Date of Patent: Feb. 17, 2026

(54) AEROSOL GENERATING ARTICLE AND AN AEROSOL GENERATING SYSTEM

(71) Applicant: JT International SA, Geneva (CH)

(72) Inventor: Andrew Robert John Rogan, Forres (GB)

(73) Assignee: JT International SA (CH)

( * ) Notice: Subject to any disclaimer, the term of this patent is extended or adjusted under 35 U.S.C. 154(b) by 546 days.

(21) Appl. No.: 17/916,833

(22) PCT Filed: Apr. 14, 2021

(86) PCT No.: PCT/EP2021/059660
§ 371 (c)(1),
(2) Date: Oct. 4, 2022

(87) PCT Pub. No.: WO2021/209499
PCT Pub. Date: Oct. 21, 2021

(65) Prior Publication Data

US 2023/0148656 A1 May 18, 2023

(30) Foreign Application Priority Data

Apr. 17, 2020 (EP) ..... 20170069

(51) Int. Cl.
*A24B 15/30* (2006.01)
*A24D 1/00* (2020.01)
(Continued)

(52) U.S. Cl.
CPC ..... *A24D 1/002* (2013.01); *A24D 1/02* (2013.01); *A24D 1/20* (2020.01); *A24F 40/20* (2020.01); *A24F 40/40* (2020.01); *A24F 40/60* (2020.01)

(58) Field of Classification Search
CPC ..... A24D 1/002; A24D 1/20
See application file for complete search history.

(56) References Cited

U.S. PATENT DOCUMENTS

2004/0261807 A1* 12/2004 Dube ..... A24D 3/14 131/331
2014/0305455 A1 10/2014 Crooks et al.
(Continued)

FOREIGN PATENT DOCUMENTS

DE 102006041042 A1 3/2008
EP 3076808 A1 10/2016
(Continued)

OTHER PUBLICATIONS

International Search Report for PCT/EP2021/059660 mailed Jul. 26, 2021. 4 pgs.

*Primary Examiner* — Philip Y Louie
*Assistant Examiner* — Charlotte Davison
(74) *Attorney, Agent, or Firm* — Lerner David LLP

(57) ABSTRACT

An aerosol generating article includes a wrapper, an aerosol generating substrate positioned in the wrapper to form a rod having a mouth end and a distal end upstream of the mouth end, and an airflow barrier positioned in the wrapper. The airflow barrier includes a deformable capsule which substantially prevents airflow from the distal end to the mouth end when in an undeformed state. The deformable capsule is deformable by a user into a deformed state which permits airflow from the distal end to the mouth end.

19 Claims, 5 Drawing Sheets

(51) Int. Cl.

| | |
|---|---|
| ***A24D 1/02*** | (2006.01) |
| ***A24D 1/04*** | (2006.01) |
| ***A24D 1/20*** | (2020.01) |
| ***A24F 40/20*** | (2020.01) |
| ***A24F 40/40*** | (2020.01) |
| ***A24F 40/46*** | (2020.01) |
| ***A24F 40/60*** | (2020.01) |

(56) References Cited

U.S. PATENT DOCUMENTS

| | | | | |
|---|---|---|---|---|
| 2015/0272203 | A1* | 10/2015 | Holford | A24C 5/005 131/365 |
| 2015/0296877 | A1* | 10/2015 | Nappi | A24D 3/043 131/339 |
| 2016/0295914 | A1 | 10/2016 | Jordil et al. | |
| 2016/0295917 | A1 | 10/2016 | Malgat et al. | |
| 2018/0110257 | A1 | 4/2018 | Besso | |
| 2019/0116874 | A1* | 4/2019 | England | A24D 1/20 |
| 2019/0343173 | A1* | 11/2019 | Figueroa | A24D 3/062 |
| 2020/0008462 | A1 | 1/2020 | Thorens | |

FOREIGN PATENT DOCUMENTS

| | | | | |
|---|---|---|---|---|
| EP | 3089601 | A1 | 11/2016 | |
| JP | 2016538847 | A | 12/2016 | |
| JP | 2018514203 | A | 6/2018 | |
| JP | 2019521658 | A | 8/2019 | |
| RU | 2674508 | C1 | 12/2018 | |
| RU | 2688390 | C1 | 5/2019 | |
| WO | 2015082650 | A1 | 6/2015 | |
| WO | 2015101605 | A1 | 7/2015 | |
| WO | WO-2019123297 | A1 * | 6/2019 | A24C 5/54 |
| WO | 2019197316 | A1 | 10/2019 | |
| WO | 2020074611 | A1 | 4/2020 | |

* cited by examiner

AEROSOL GENERATING ARTICLE AND AN AEROSOL GENERATING SYSTEM

TECHNICAL FIELD

The present disclosure relates generally to aerosol generating articles, and more particularly to an aerosol generating article for use with an aerosol generating device for heating the aerosol generating article to generate an aerosol for inhalation by a user. Embodiments of the present disclosure also relate to an aerosol generating system comprising an aerosol generating device and an aerosol generating article.

TECHNICAL BACKGROUND

Devices which heat, rather than bum, an aerosol generating substrate to produce an aerosol for inhalation have become popular with consumers in recent years. Such devices can use one of a number of different approaches to provide heat to the aerosol generating substrate, including resistive heating and induction heating.

Whichever approach is used to heat the aerosol generating substrate, it can be convenient to provide the aerosol generating substrate in the form of an aerosol generating article that is configured for use with an aerosol generating device. Aerosol generating articles are known in the art and typically comprise an aerosol generating substrate positioned at a distal end of the aerosol generating article and a filter positioned at the proximal (mouth) end.

It is conceivable that a user may inadvertently attempt to ignite the aerosol generating article in a conventional manner, using a flame or other ignition source. There is, therefore, a need to provide an aerosol generating article, for use with an aerosol generating device, which has a reduced susceptibility to ignition using a flame or other ignition source.

SUMMARY OF THE DISCLOSURE

According to a first aspect of the present disclosure, there is provided an aerosol generating article comprising:

a wrapper;

an aerosol generating substrate positioned in the wrapper to form a rod having a mouth end and a distal end upstream of the mouth end; and an airflow barrier positioned in the wrapper;

the airflow barrier comprising a deformable capsule which substantially prevents airflow from the distal end to the mouth end when in an undeformed state and which is deformable by a user into a deformed state which permits airflow from the distal end to the mouth end.

The aerosol generating article is configured for use with an aerosol generating device for heating the aerosol generating substrate, without burning the aerosol generating substrate, to volatise at least one component of the aerosol generating substrate and thereby generate a vapour which cools and condenses to form an aerosol for inhalation by a user of the aerosol generating device.

In general terms, a vapour is a substance in the gas phase at a temperature lower than its critical temperature, which means that the vapour can be condensed to a liquid by increasing its pressure without reducing the temperature, whereas an aerosol is a suspension of fine solid particles or liquid droplets, in air or another gas. It should, however, be noted that the terms 'aerosol' and 'vapour' may be used interchangeably in this specification, particularly with regard to the form of the inhalable medium that is generated for inhalation by a user.

By substantially preventing airflow from the distal end to the mouth end of the rod when a user draws on the mouth end, the undeformed airflow barrier reduces the likelihood of the user being able to ignite the aerosol generating substrate, for example using an external ignition source, such as a flame, applied to the distal end. This is because the airflow through the aerosol generating article is insufficient to permit ignition and/or sustain combustion of the aerosol generating substrate.

The aerosol generating substrate is typically positioned at the distal end of the rod. The aerosol generating article may include a filter positioned at the mouth end of the rod. The filter may, for example, comprise cellulose acetate fibres and/or paper.

The deformable capsule may have an outer dimension, e.g. an outer diameter, which is substantially equal to a diameter of the filter. The deformable capsule may have an outer dimension, e.g. an outer diameter, which is substantially equal to an inner diameter of the wrapper.

When the deformable capsule is in the undeformed state, the capsule may span an inner cross-section of the wrapper to substantially prevent airflow from the distal end to the mouth end. Since airflow between an outer surface of the capsule and an inner surface of the wrapper is substantially prevented, airflow through the aerosol generating substrate is reliably substantially prevented when the deformable capsule is in the undeformed state.

The deformable capsule may have a cross-sectional area which is at least 90% of the cross-sectional area of the filter, more preferably 95%, even more preferably between 98% and 100%. The cross-sectional area of the filter is meant to be the cross-sectional or surface area of the filter without considering the thickness of the wrapper (e.g. plug wrap).

The capsule may be configured to permit airflow from the distal end to the mouth end between an outer surface of the capsule and an inner surface of the wrapper when the capsule is in the deformed state. Airflow through the aerosol generating substrate is thereby readily permitted, allowing the aerosol generated during use of the aerosol generating article with an aerosol generating device to be inhaled by a user.

In a first example, the deformable capsule may be configured to be deformed from the undeformed state into the deformed state upon the application of a force by a user's fingers. The capsule can be readily and conveniently deformed by a user to permit airflow from the distal end to the mouth end when a user wishes to use the aerosol generating article with an aerosol generating device for the purpose of aerosol generation. The deformable capsule may have a crush strength of between 4.9 N and 24.5 N when in the undeformed state. A force within this range can be conveniently applied by a user's fingers, allowing the deformable capsule to be readily deformed from the undeformed state into the deformed state by a user without the need for a separate crushing tool.

In a second example, the deformable capsule may have a crush strength greater than 24.5 N, possibly between 25 N and 100 N, and preferably between 25 N and 50 N. Thus, the deformable capsule may be configured to be deformed from the undeformed state into the deformed state upon the application of a force greater than 24.5 N, possibly between 25 N and 100 N, and preferably between about 25 N and 50 N. In this example, the relatively high crush strength of the deformable capsule means that it cannot be crushed by a user's fingers, thus ensuring that the aerosol generating article is child proof The relatively high crush strength may also facilitate manufacture of aerosol generating articles according to the present disclosure, because the aerosol generating articles can be processed and manufactured using a conventional manufacturing machine without risk of the deformable capsule being crushed by the forces applied during processing and manufacture. This is the case even when the outer diameter of the deformable capsule is substantially equal to the diameter of the filter.

In this second example, a crushing tool may be needed to apply the necessary crushing force to the deformable capsule to deform the capsule from the undeformed state into the deformed state. The crushing tool may be configured for use specifically with the aerosol generating article. The crushing tool could be provided as part of an aerosol generating device, ensuring that the aerosol generating article can only be used with an aerosol generating device having the necessary crushing tool.

The deformable capsule may be substantially spherical when in the undeformed state. A spherical capsule may be easy to manufacture and may facilitate manufacture of aerosol generating articles according to the present disclosure because it can be readily processed using a conventional manufacturing machine. A spherical capsule may also be a particularly convenient shape to substantially prevent airflow through the aerosol generating article when the capsule is in the undeformed state.

The deformable capsule may be a crushable capsule. The use of a crushable capsule allows the capsule to be transformed from the undeformed state to the deformed state whilst remaining intact.

The deformable capsule may be a frangible capsule and may comprise a frangible shell. When a force is applied to the frangible capsule which exceeds its compressive strength, the frangible capsule breaks up into fragments, perforates or collapses. An enhanced airflow through the aerosol generating article may, therefore, be achieved through the use of a frangible capsule.

The deformable capsule may contain a flavourant which may be released upon deformation of the capsule from the undeformed state into the deformed state. The flavourant may be a liquid flavourant. By incorporating a flavourant into the deformable capsule, additional flavours may be provided to the user during use of the aerosol generating article in an aerosol generating device. The flavourant may be used to enhance the flavour(s) produced upon heating the aerosol generating substrate, or to provide a different flavour, including (but not limited to) menthol, mint or berry.

The frangible shell may be substantially impermeable when the capsule is in the undeformed state and the flavourant may be contained inside the impermeable shell. Thus, the flavourant may be preserved inside the capsule prior to use of the aerosol generating article, thereby preventing (or at least minimising) degradation of the flavourant and improving the shelf-life of the aerosol generating article.

The deformable capsule may comprise a layer or discrete pieces which may include a vapour cooling substance. The layer may be an outer layer of the capsule. The discrete pieces may be powder and the like contained inside the capsule and exposed to vapour when the capsule is crushed. The vapour cooling substance may comprise polylactic acid. The vapour cooling substance promotes cooling of the vapour or aerosol as it flows towards the mouth end of the rod to form an aerosol with suitable characteristics for inhalation by a user.

The deformable capsule may be positioned in the wrapper downstream of the aerosol generating substrate. The deformable capsule may be positioned in the wrapper upstream of the mouth end, and may be positioned upstream of the optional filter positioned at the mouth end.

The aerosol generating article may include a vapour cooling element positioned in the wrapper downstream of the aerosol generating substrate. The vapour cooling element promotes cooling of the vapour as it flows from the aerosol generating substrate towards the mouth end to form an aerosol with suitable characteristics for inhalation by a user. The deformable capsule may be positioned downstream of the vapour cooling element. Such positioning may help to improve flavour enhancement as the vapour or aerosol flows in a downstream direction from the vapour cooling element towards the mouth end.

The vapour cooling element may comprise a hollow paper tube which may have a thickness greater than a thickness of the wrapper. Manufacture of aerosol generating articles according to the present disclosure is thereby facilitated.

The aerosol generating substrate may comprise a non-liquid aerosol generating material, for example any type of solid or semi-solid material. Example types of aerosol generating substrate include powder, granules, pellets, shreds, strands, particles, gel, strips, loose leaves, cut leaves, cut filler, porous material, foam material or sheets. The aerosol generating substrate may comprise plant derived material and in particular, may comprise tobacco. It may advantageously comprise reconstituted tobacco.

The aerosol generating substrate may comprise a plug of aerosol generating material. That is, the aerosol generating substrate may comprise an aerosol generating plug. The aerosol generating substrate may comprise a tobacco plug.

The aerosol generating substrate may comprise an aerosol-former. Examples of aerosol-formers include polyhydric alcohols and mixtures thereof such as glycerine or propylene glycol. Typically, the aerosol generating substrate may comprise an aerosol-former content of between approximately 5% and approximately 50% on a dry weight basis. In some embodiments, the aerosol generating substrate may comprise an aerosol-former content of between approximately 10% and approximately 20% on a dry weight basis, and possibly approximately 15% on a dry weight basis.

Upon heating, the aerosol generating substrate may release volatile compounds. The volatile compounds may include nicotine and/or flavour compounds such as tobacco flavouring.

The wrapper may comprise a material which is substantially non-electrically conductive and non-magnetically permeable and may, for example, comprise a paper wrapper. The use of a wrapper may facilitate manufacture and handing of the aerosol generating article and may enhance aerosol generation.

According to a second aspect of the present disclosure, there is provided an aerosol generating system comprising:

- an aerosol generating article according to the first aspect; and
- an aerosol generating device including: a crushing tool configured to allow a user to apply a force to the deformable capsule to permit deformation of the capsule by the user from the undeformed state into the deformed state; and a heater for heating the aerosol generating substrate to generate an aerosol for inhalation by a user.

The aerosol generating article may be as defined above. As noted above, the crushing tool allows a user to apply the necessary crushing force to the deformable capsule to deform the capsule from the undeformed state into the deformed state and allows the capsule to be manufactured with a sufficiently high crush strength (above 24.5 N) that the aerosol generating article is child proof.

The crushing tool may comprise a user-operable lever and a crushing plate. The user-operable lever may be pivotally mounted on a device body or housing of the aerosol generating device and may be movable between a first position and a second position. Upon user operation to move the user-operable lever from the first position to the second position, the crushing plate may be correspondingly moved from a retracted position to an advanced position in which the crushing plate compresses the deformable capsule.

The user-operable lever and the crushing plate may be configured to provide a mechanical advantage, such that the force applied to the deformable capsule by the crushing plate is greater than the force applied by a user to the user-operable lever. The crushing tool thus allows a deformable capsule with a high crush strength (above 24.5 N) to be crushed with relative ease.

The user-operable lever may be biased to the first position. Thus, the crushing plate is similarly biased to the retracted position unless a force is applied by a user to the user-operable lever.

The heater may comprise a heating blade.

The heater may comprise a heating tube comprising a chamber dimensioned to at least receive the aerosol generating substrate of the aerosol generating article.

The heater may comprise a resistive heater. The resistive heater may comprise a resistive heating element, for example a resistive heating blade or a resistive heating tube.

The heater may comprise an induction heatable susceptor and the aerosol generating device may comprise an electromagnetic field generator, such as an induction coil, arranged to generate an alternating electromagnetic field for inductively heating the induction heatable susceptor. This arrangement provides a particularly convenient way to heat the aerosol generating substrate using induction heating.

The induction coil may comprise a Litz wire or a Litz cable. It will, however, be understood that other materials could be used. The induction coil may be substantially helical in shape and may extend around a heating chamber in which the aerosol generating article is positioned in use. The circular cross-section of a helical induction coil may, for example, facilitate the insertion of the aerosol generating article comprising the aerosol generating substrate and optionally one or more of said induction heatable susceptors, into the heating chamber and ensures uniform heating of the aerosol generating substrate.

The induction heatable susceptor may comprise one or more, but not limited, of aluminium, iron, nickel, stainless steel and alloys thereof, e.g. Nickel Chromium or Nickel Copper. With the application of an electromagnetic field in its vicinity, the susceptor may generate heat due to eddy currents and magnetic hysteresis losses resulting in a conversion of energy from electromagnetic to heat.

The induction coil may be arranged to operate in use with a fluctuating electromagnetic field having a magnetic flux density of between approximately 20 mT and approximately 2.0 T at the point of highest concentration.

The aerosol generating device may include a power source and circuitry which may be configured to operate at a high frequency. The power source and circuitry may be configured to operate at a frequency of between approximately 80 kHz and 500 kHz, possibly between approximately 150 kHz and 250 kHz, and possibly at approximately 200 kHz. The power source and circuitry could be configured to operate at a higher frequency, for example in the MHz range, depending on the type of induction heatable susceptor that is used.

DETAILED DESCRIPTION OF EMBODIMENTS

Embodiments of the present disclosure will now be described by way of example only and with reference to the accompanying drawings.

Figure 1:
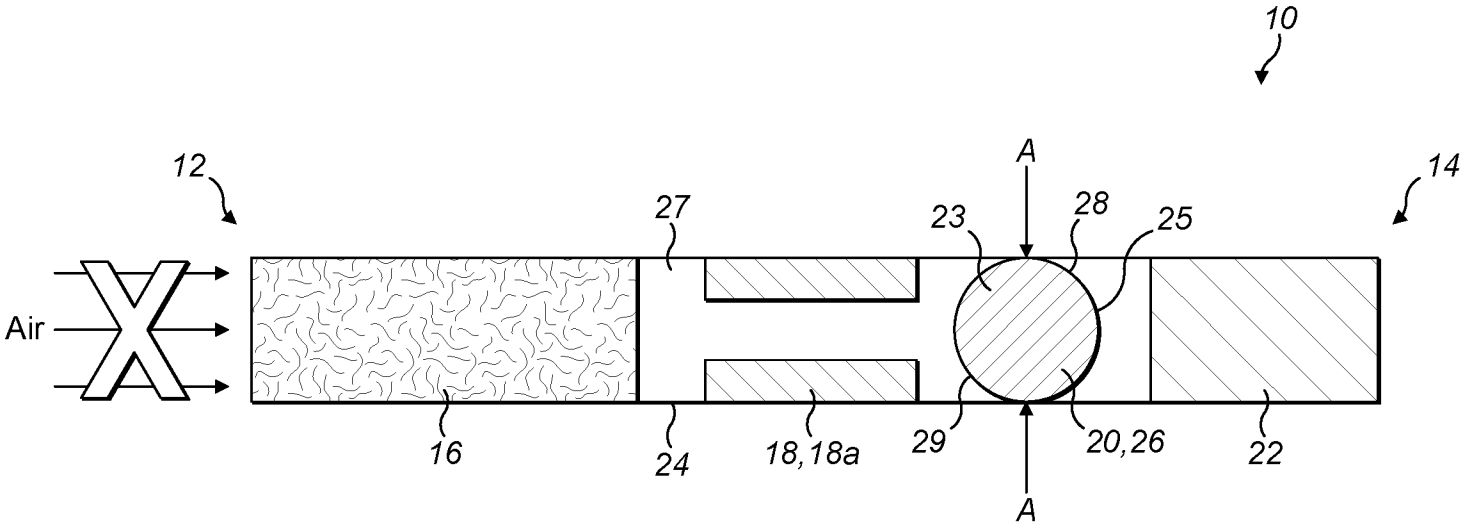
FIG. 1 is diagrammatic cross-sectional view of an aerosol generating article illustrating how airflow is substantially prevented through the article from a distal end to a mouth end by an airflow barrier.
Figure 2:
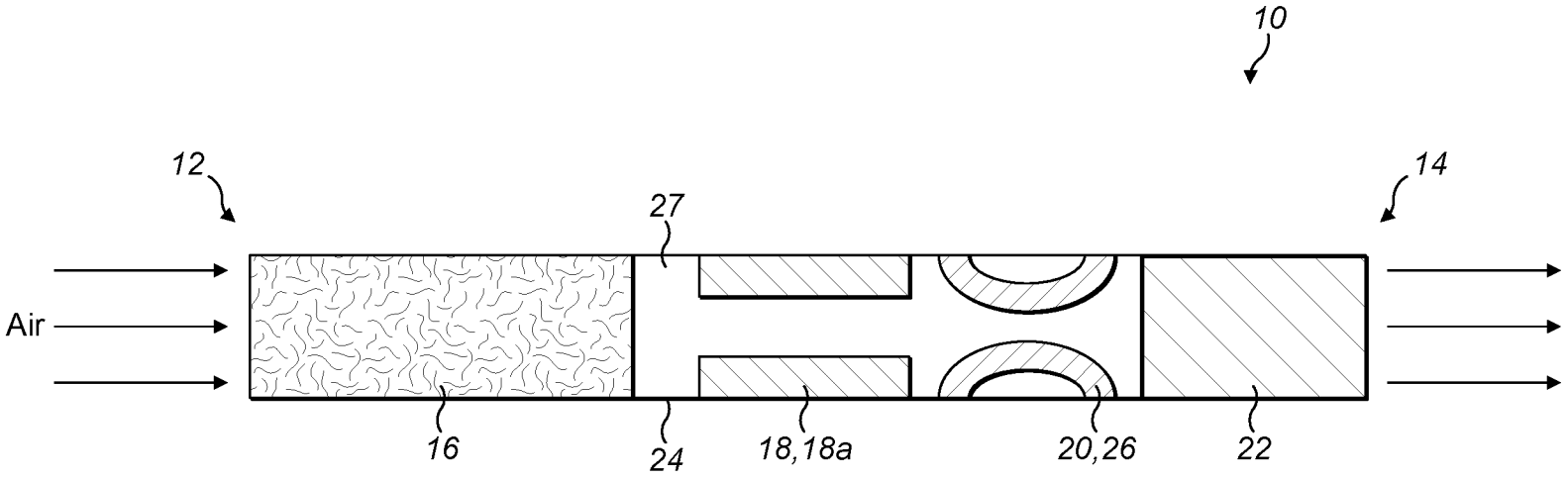
FIG. 2 is a diagrammatic cross-sectional view of the aerosol generating article of FIG. 1 illustrating how airflow is permitted from the distal end to the mouth end following deformation of the airflow barrier.

Referring initially to FIGS. 1 and 2, there is shown diagrammatically a first example of an aerosol generating article 10. The aerosol generating article 10 is elongate and substantially cylindrical and is of a so-called "stick" type. Airflow through the aerosol generating article 10 is from left to right as viewed in FIG. 2, from a distal (or upstream) end 12 to a mouth (or downstream) end 14 as denoted by the arrows.

The aerosol generating article 10 comprises the following elements arranged sequentially and in co-axial alignment in a downstream direction, in other words from the distal end 12 to the mouth end 14: an aerosol generating substrate 16, an optional vapour cooling element 18, an airflow barrier 20 (e.g. deformable capsule 26) and an optional filter 22, for example comprising cellulose acetate fibres. The elements are all assembled inside a wrapper 24 to form a rod, and the wrapper 24 holds the elements in position to form the aerosol generating article 10. The wrapper 24 is substantially non-electrically conductive and non-magnetically permeable, and typically comprises a paper wrapper, e.g., formed of cigarette paper.

The aerosol generating substrate 16 comprises a solid or semi-solid material (i.e. a non-liquid material) and may comprise plant derived material, and in particular tobacco. The aerosol generating substrate 16 typically comprises a tobacco plug. The aerosol generating substrate 16 may include an aerosol-former, such as glycerine or propylene glycol, to facilitate the generation of a vapour or aerosol when heated.

The vapour cooling element 18 typically comprises a hollow paper tube 18*a* having a thickness which is greater than the thickness of the paper wrapper 24. As heated vapour flows through the vapour cooling element 18 in the downstream direction, from the aerosol generating substrate 16 towards the mouth end 14, the vapour cools and condenses to form an aerosol with suitable characteristics for inhalation by a user. The vapour cooling element 18 (e.g. hollow paper tube 18*a*) may contact the aerosol generating substrate 16 at a first end and/or the airflow barrier 20 (e.g. deformable capsule 26) at a second end. Ventilation may be provided through the hollow paper tube 18*a* and wrapper 24 such as by a multitude of perforations.

The airflow barrier 20 comprises a deformable capsule 26 which can be deformed by a user from an initially undeformed state as shown in FIG. 1 into a deformed state as schematically shown in FIG. 2. Note that the deformed state shown in FIG. 2 is highly schematic, and that the capsule 26 may simply be crushed or may break into many parts when it is deformed by a user. When the capsule 26 is in the undeformed state shown in FIG. 1, the capsule 26 prevents airflow from the distal end 12 to the mouth end 14 of the aerosol generating article 10 through the aerosol generating substrate 16, as denoted schematically by the arrows in FIG. 1. When the capsule 26 is in the deformed state shown in FIG. 2, the capsule 26 permits airflow from the distal end 12 to the mouth end 14 of the aerosol generating article 10 through the aerosol generating substrate 16, as denoted schematically by the arrows in FIG. 2.

In the illustrated example, the deformable capsule 26 is substantially spherical when in the undeformed state shown in FIG. 1 and has an outer diameter which is substantially equal to an inner diameter of the wrapper 24 and to a diameter of the filter 22. When the deformable capsule 26 is in the undeformed state, it spans the cross-section of an airflow channel 27 defined by the paper wrapper 24 and has a transverse cross-sectional area which is substantially equal to the free cross-section of the interior of the paper wrapper 24. The airflow channel 27 defined by the paper wrapper 24 is, thus, substantially occluded (i.e. blocked) to substantially prevent or limit air flow between an outer surface of the deformable capsule 26 and an inner surface of the paper wrapper 24. Airflow from the distal end 12 to the mouth end 14 of the aerosol generating article 10 is thereby substantially prevented or limited, thereby creating a high resistance to draw when the deformable capsule 26 is in the undeformed state.

Prior to use of the aerosol generating article 10 with an electrically-operated aerosol generating device, the deformable capsule 26 must be deformed to transform it from the undeformed state shown in FIG. 1 into the deformed state shown in FIG. 2. As will be apparent from FIG. 2, when the deformable capsule 26 is in the deformed state, the airflow channel 27 is no longer completely occluded and air can flow along the airflow channel 27, for example between the outer surface of the deformable capsule 26 and the inner surface of the paper wrapper 24. Airflow from the distal end 12 to the mouth end 14 of the aerosol generating article 10 is, thereby, permitted when the deformable capsule 26 is in the deformed state, enabling the aerosol generating article 10 to be used with an electrically-operated aerosol generating device.

The deformable capsule 26 can be a crushable capsule as illustrated in FIGS. 1 and 2, such that the capsule 26 remains intact or perforates when it is crushed to transform it from the undeformed state into the deformed state. In another example, the deformable capsule 26 can be a frangible capsule comprising a frangible shell 28. When a force is applied to the capsule 26 which exceeds its compressive strength, the frangible capsule breaks up into fragments, thus allowing air to flow through the airflow channel 27.

The deformable capsule 26 can contain a flavourant 23 that is released upon deformation of the capsule 26 to enhance or modify the flavour of the aerosol delivered to the user when the aerosol generating article 10 is used with an electrically-operated aerosol generating device. The flavourant 23 can be a liquid flavourant 23 and, in this case, it is preferred that the deformable capsule 26 comprises an impermeable shell 28. The impermeable shell 28 retains the flavourant 23 inside the capsule 26 when it is in the undeformed state. The impermeable shell 28 ruptures or bursts when the capsule 26 is deformed, thereby releasing the flavourant 23.

In order to further promote the cooling of heated vapour as it flows from the aerosol generating substrate 16 towards the mouth end 14, the deformable capsule 26 can comprise an outer layer 29 including a vapour cooling substance 25. The vapour cooling substance 25 may, for example, comprise a polylactic acid although it will be understood that other vapour cooling substances such as cooling liquid may be used.

In order to transform the deformable capsule 26 from the undeformed state shown in FIG. 1 into the deformed state shown in FIG. 2, it is necessary to apply a compressive force to the deformable capsule 26 which exceeds the crush strength of the capsule 26. In a first embodiment, the deformable capsule 26 has a crush strength of between about 4.9 N and about 24.5 N. With a crush strength in this range, the deformable capsule 26 can be transformed from the undeformed state into the deformed state upon the application of a compressive force by a user's fingers as denoted by the arrows A in FIG. 1, thereby enabling the deformable capsule 26 to be readily and conveniently deformed by a user without the need for a separate crushing tool. In a second embodiment, the deformable capsule 26 has a crush strength greater than 24.5 N, possibly between 25 N and 100 N, and preferably between 25 N and 50 N. With a crush strength in these ranges, the deformable capsule 26 cannot be deformed easily upon the application of a compressive force by a user's fingers, thereby ensuring that the aerosol generating article 10 is child proof. Instead, a separate crushing tool must be used to apply the required compressive force to the capsule 26 to deform it. An example of a suitable crushing tool will be described later in this specification, with reference to FIG. 5.

Figure 3:
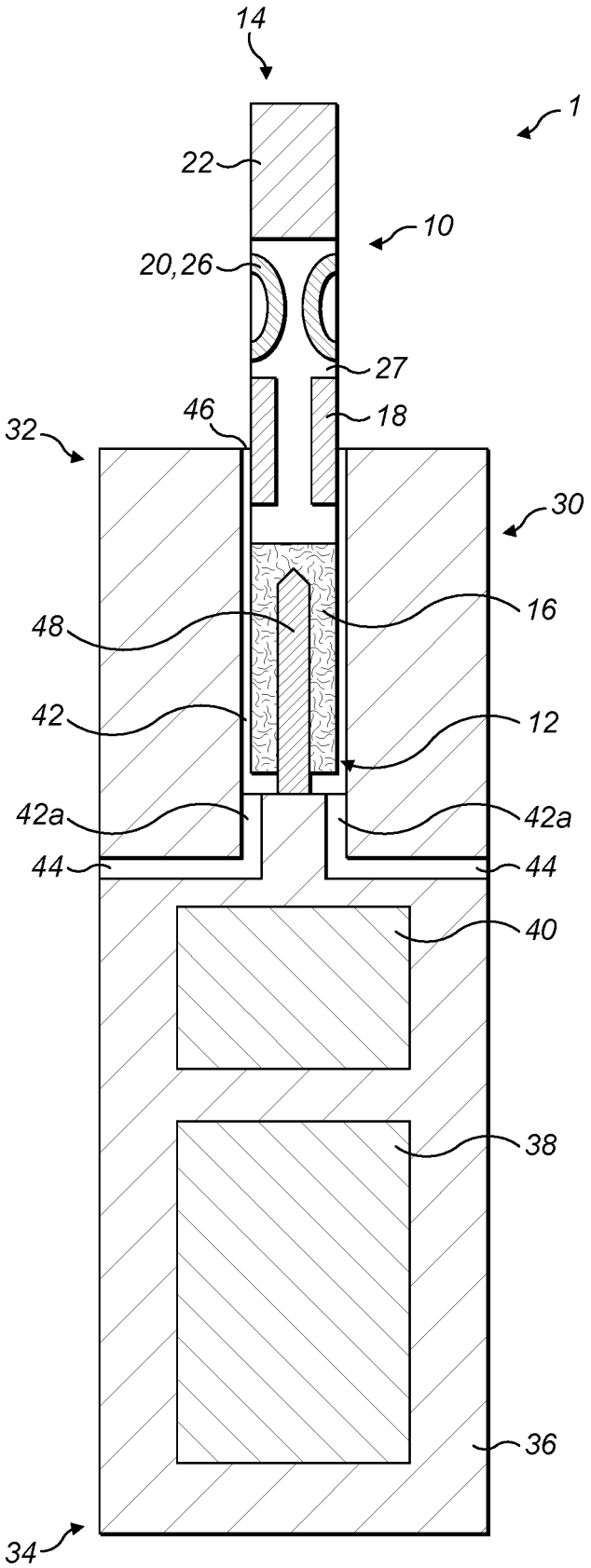
FIG. 3 is a diagrammatic cross-sectional view of a first example of an aerosol generating system comprising a first example of an electrically-operated aerosol generating device and the aerosol generating article illustrated in FIGS. 1 and 2.

Referring now to FIG. 3, there is shown diagrammatically a first example of an aerosol generating system 1. The aerosol generating system 1 comprises a first example of an electrically-operated aerosol generating device 30 and an aerosol generating article 10 as described above. The aerosol generating device 30 has a proximal end 32 and a distal end 34 and comprises a device body 36 which includes a power source 38 and a controller 40 which may be configured to operate at high frequency. The power source 38 typically comprises one or more batteries which could, for example, be inductively rechargeable.

The aerosol generating device 30 comprises a substantially cylindrical heating chamber 42 having air inlets 42*a*. The heating chamber 42 is positioned at the proximal end 32 of the aerosol generating device 30 and is arranged to receive the substantially cylindrical aerosol generating article 10. The aerosol generating device 30 includes a plurality of air inlets 44 formed in the device body 36 which deliver air to the heating chamber 42 via the air inlets 42*a*.

The aerosol generating article 10 is positioned in the heating chamber 42 by inserting the distal end 12 into the heating chamber 42 via an opening 46. The heating chamber 42 and aerosol generating article 10 are dimensioned so that the mouth end 14, and in particular the filter 22, projects from the heating chamber 42 at the proximal end 32 of the aerosol generating device 30. Prior to inserting the aerosol generating article 10 into the heating chamber 42, a compressive force is applied to the deformable capsule 26 in the manner described above to transform it from the undeformed state into the deformed state, and thereby allow air to flow from the air inlets 44, 42*a* and through the aerosol generating article 10.

The aerosol generating device 30 comprises a resistive heating element 48 mounted on the device body 36 so that it projects into the heating chamber 42. Thus, the heating element 48 is inserted into the aerosol generating substrate 16 during insertion of an aerosol generating article 10 into the heating chamber 42 by a user. For example, the heating element 48 could be a blade or an elongate pin which penetrates the aerosol generating substrate 16 as the aerosol generating article 10 is inserted into the heating chamber 42.

During operation of the aerosol generating device 30, electrical energy is supplied by the power source 38 to the resistive heating element 48 and the resistive heating element 48 is thereby heated. The heat is transferred from the resistive heating element 48 to the aerosol generating substrate 16, causing it to heat up without burning and thereby produce a vapour. The vaporisation of the aerosol generating substrate 16 is facilitated by the addition of air from the surrounding environment through the air inlets 44, 42*a* or the opening 46. The vapour generated by heating the aerosol generating substrate 16 cools and condenses as it flows through airflow channel 27 and the vapour cooling element 18. In examples in which the deformable capsule 26 comprises a vapour cooling substance 25 as described above, further cooling takes places as the vapour or aerosol flows around the deformed capsule 26. The resultant aerosol finally passes through the filter 22, and is inhaled by a user. It will be understood that the flow of air through the aerosol generating article 10, i.e. from the air inlets 44, 42*a* or the opening 46, through the airflow channel 27 and through the filter 22, is aided by negative pressure created by a user drawing air from the outlet side of the device 10 through the filter 22.

Figure 4:
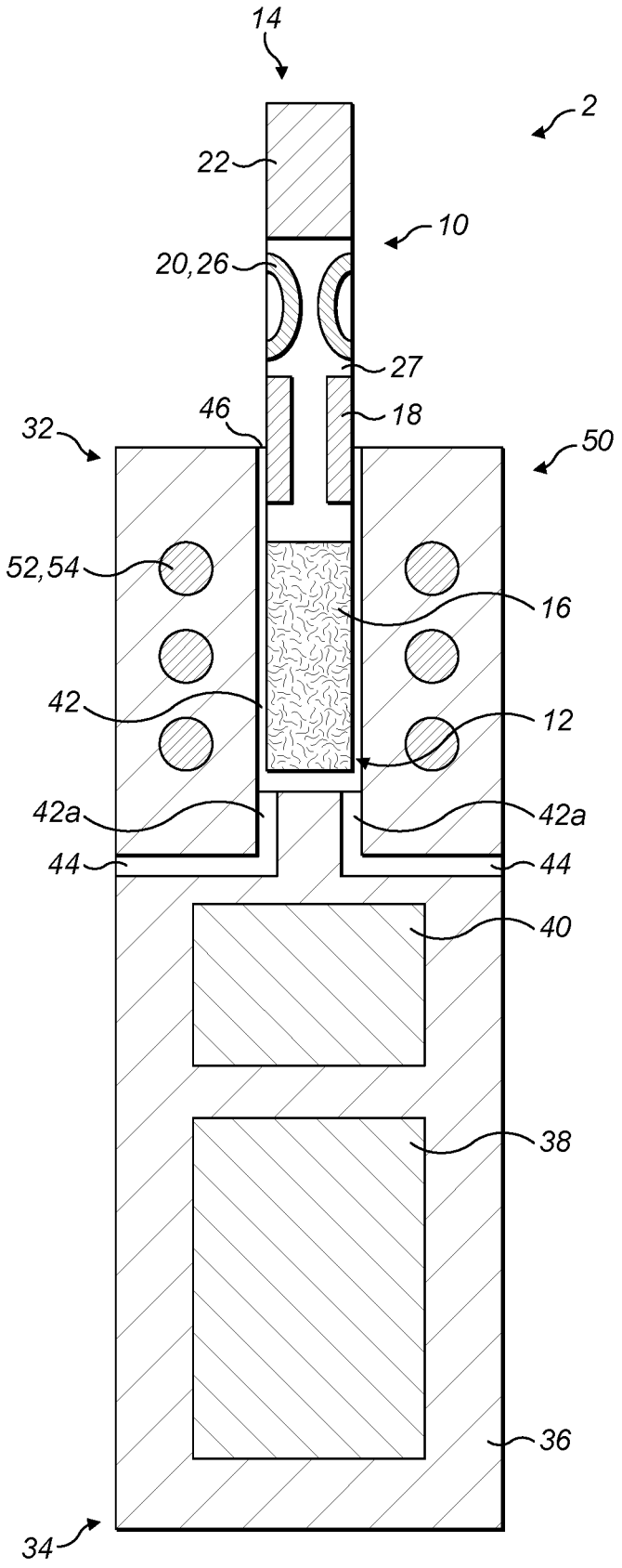
FIG. 4 is a diagrammatic cross-sectional view of a second example of an aerosol generating system comprising a second example of an electrically-operated aerosol generating device and the aerosol generating article illustrated in FIGS. 1 and 2.

Referring now to FIG. 4, there is shown diagrammatically a second example of an aerosol generating system 2. The aerosol generating system 2 is similar to the aerosol generating system 1 described above with reference to FIG. 3, and corresponding components are identified using the same reference numerals.

The aerosol generating system 2 comprises a second example of an electrically-operated aerosol generating device 50 and an aerosol generating article 10 as described above.

The aerosol generating device 50 comprises a magnetic field generator 52 for generating an electromagnetic field. The magnetic field generator 52 comprises a substantially helical induction coil 54. The induction coil 54 has a circular cross-section and extends around the substantially cylindrical heating chamber 42. The induction coil 54 can be energised by the power source 38 and controller 40. The controller 40 includes, amongst other electronic components, an inverter which is arranged to convert a direct current from the power source 38 into an alternating high-frequency current for the induction coil 54.

The aerosol generating system 2 further includes an induction heatable susceptor (not shown) located proximate, or in contact with, the aerosol generating substrate 16. The induction heatable susceptor may, for example, comprise a blade-shaped or pin-shaped or ring-shaped susceptor mounted on the device body in the same way as the resistive heating element 48 illustrated in FIG. 3. The induction heatable susceptor may alternatively comprise a particulate susceptor material which is dispersed throughout the aerosol generating substrate 16 during manufacture and assembly of the aerosol generating article 10.

Irrespective of the particular configuration of the induction heatable susceptor, and as will be understood by one of ordinary skill in the art, when the induction coil 54 is energised during use of the aerosol generating system 2, an alternating and time-varying electromagnetic field is produced. This couples with the induction heatable susceptor and generates eddy currents and/or magnetic hysteresis losses in the susceptor causing it to heat up. The heat is then transferred from the induction heatable susceptor to the aerosol generating substrate 16, for example by conduction, radiation and convection, to heat the aerosol generating substrate 16 without burning and thereby produce a vapour. The flow of vapour and aerosol through the aerosol generating device 50 is the same as that described above in connection with the aerosol generating device 30 of FIG. 3.

Figure 5:
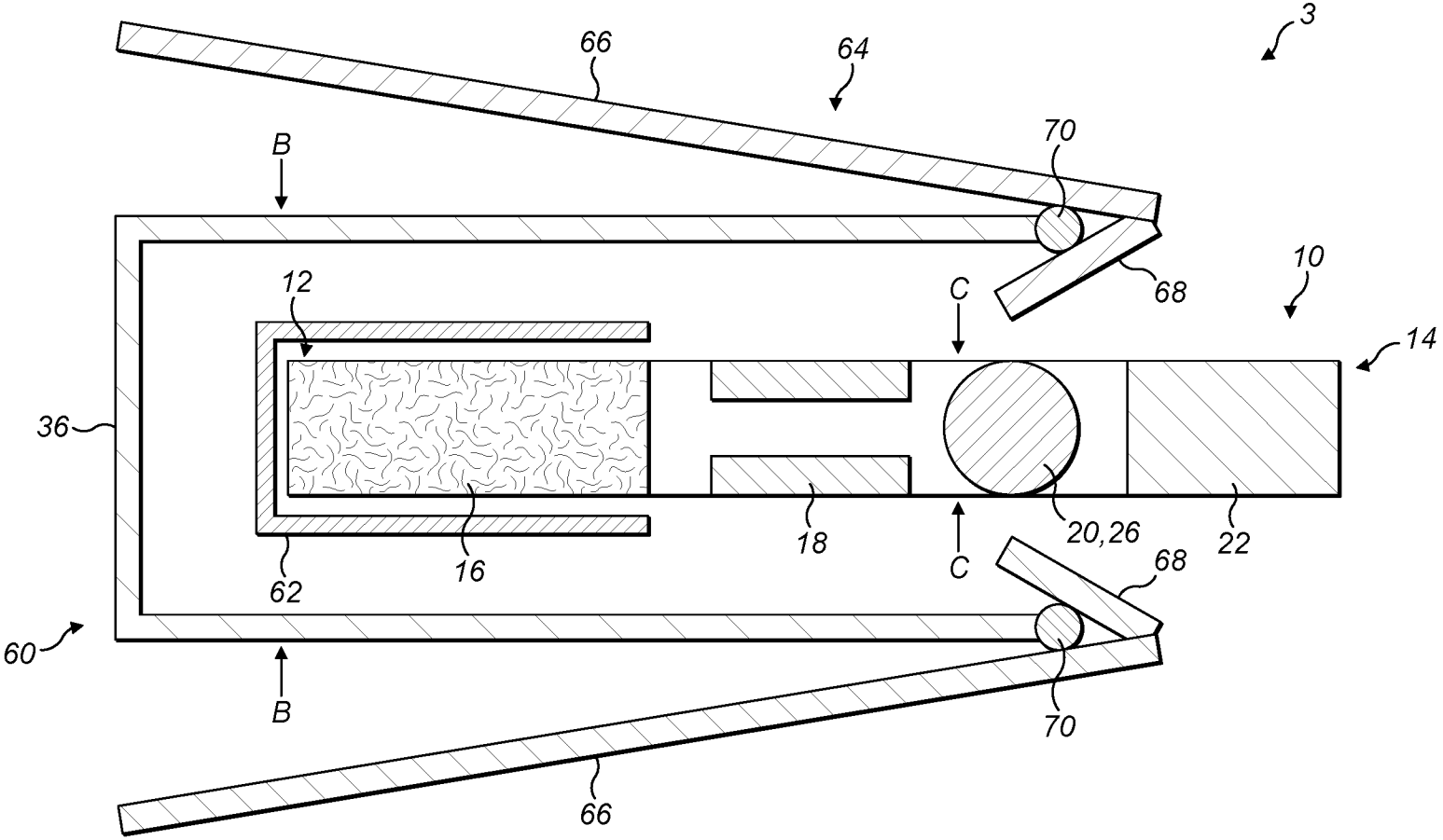
FIG. 5 is a diagrammatic cross-sectional view of part of a third example of an aerosol generating system comprising a third example of an electrically-operated aerosol generating device and the aerosol generating article illustrated in FIGS. 1 and 2.

Referring now to FIG. 5, there is shown diagrammatically a third example of part of an aerosol generating system 3. The aerosol generating system 3 is similar to the aerosol generating systems 1, 2 described above with reference to FIGS. 3 and 4, and corresponding components are identified using the same reference numerals.

The aerosol generating system 3 comprises an aerosol generating device 60 for receiving the aerosol generating article 10. It will be understood by one of ordinary skill in the art that only part of the aerosol generating device 60 is shown in FIG. 5, and in particular that the power source and controller described above are not shown. The aerosol generating device 60 comprises a cup-shaped heater 62 which receives the distal end 12 of the aerosol generating article 10 when the aerosol generating article 10 is inserted into the aerosol generating device 60. The cup-shaped heater 62 can be a resistive heater as described above with reference to FIG. 3 or an induction heatable susceptor as described above with reference to FIG. 4 or a metal cup onto which a thin film heater is affixed such as described in WO 2020/074611 A1 entitled "Aerosol generation device and heating chamber therefor". In all cases, it will be understood that during operation of the aerosol generating device 60, heat is transferred from the cup-shaped heater 62 to the adjacent aerosol generating substrate 16 to thereby heat the aerosol generating substrate 16 without burning to produce a vapour.

The aerosol generating device 60 is particularly suitable for use with an aerosol generating article 10 in which the deformable capsule 26 has a high crush strength, for example above 24.5 N as described above, and which cannot, therefore, be crushed by a compressive force applied directly by a user's fingers. Accordingly, the aerosol generating device 60 includes a crushing tool 64 that is configured to allow a user to apply a suitable crushing force to the deformable capsule 26 to deform the capsule 26 from the undeformed state shown in FIGS. 1 and 5 into the deformed state shown in FIG. 2. As will be understood by one of ordinary skill in the art, deformation of the capsule 26 takes place after the aerosol generating article 10 has been inserted into the aerosol generating device 60.

In the illustrated example, the crushing tool 64 comprises a pair of user-operable levers 66 and associated crushing plates 68 positioned at diametrically opposite locations on the device body 36. Each of the user-operable levers 66 is pivotally mounted on the device body 36 by a pivotal mounting 70 and is movable by a user towards the device body 36 in the direction of the arrows B from a first position shown in FIG. 5 to a second position.

The aerosol generating device 60 is dimensioned so that the user-operable levers 66 can be grasped by a user and moved simultaneously from the first position to the second position in the direction of the arrows B. Upon movement of the user-operable levers 66 by a user from the first position to the second position, the associated crushing plates 68 are correspondingly moved about the pivotal mounting 70 in the direction of the arrows C from a retracted position shown in FIG. 5 to an advanced position in which the crushing plates 68 contact the deformable capsule 26. As the crushing plates 68 move towards each other in the direction of the arrows C and contact the deformable capsule 26, the deformable capsule 26 is crushed between the crushing plates 68 and transformed from the undeformed state shown in FIGS. 1 and 5 into the deformed state shown in FIG. 2.

The user-operable levers 66 are spring-biased to the first position. Thus, when the user-operable levers 66 are released by a user, the crushing plates 68 are correspondingly biased to the retracted position shown in FIG. 5.

The user-operable levers 66 and the crushing plates 68 are configured to provide a mechanical advantage. Accordingly, the force applied to the deformable capsule 26 by the crushing plates 68 is greater than the force applied by a user to the user-operable levers 66, meaning that a deformable capsule 26 with a high crush strength can be easily crushed using the crushing tool 64.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments.

Any combination of the above-described features in all possible variations thereof is encompassed by the present disclosure unless otherwise indicated herein or otherwise clearly contradicted by context.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. An aerosol generating article comprising:

a wrapper defining an airflow channel;

an aerosol generating substrate positioned in the wrapper to form a rod having a mouth end and a distal end upstream of the mouth end; and an airflow barrier positioned in the airflow channel, wherein the airflow barrier has a cross-sectional area that is at least 95% of a cross-sectional area of the airflow channel;

the airflow barrier comprising a deformable capsule which substantially prevents airflow from the distal end to the mouth end when in an undeformed state and which is deformable by a user into a deformed state which permits airflow from the distal end to the mouth end.

2. The aerosol generating article according to claim 1, wherein, when the deformable capsule is in the undeformed state, the deformable capsule spans in the airflow channel to substantially prevent airflow from the distal end to the mouth end.

3. The aerosol generating article according to claim 1, wherein the deformable capsule is configured to permit airflow from the distal end to the mouth end between an outer surface of the deformable capsule and an inner surface of the wrapper when the deformable capsule is in the deformed state.

4. The aerosol generating article according to claim 1, wherein the deformable capsule is configured to be deformed from the undeformed state into the deformed state upon application of a force by a user's fingers.

5. The aerosol generating article according to claim 1, wherein the deformable capsule is configured to be deformed from the undeformed state into the deformed state upon application of a force greater than 24.5 N.

6. The aerosol generating article according to claim 1, wherein the deformable capsule is substantially spherical when in the undeformed state.

7. The aerosol generating article according to claim 1, wherein the deformable capsule is a crushable capsule or a frangible capsule comprising a frangible shell.

8. The aerosol generating article according to claim 7, wherein the deformable capsule contains a flavourant which is released upon deformation of the deformable capsule by a user from the undeformed state into the deformed state.

9. The aerosol generating article according to claim 8, wherein the frangible shell is substantially impermeable when the deformable capsule is in the undeformed state and the flavourant is contained inside the impermeable shell.

10. The aerosol generating article according to claim 1, wherein the deformable capsule comprises a layer or discrete pieces including a vapour cooling substance.

11. The aerosol generating article according to claim 10, wherein the vapour cooling substance comprises polylactic acid.

12. The aerosol generating article according to claim 1, wherein the deformable capsule is positioned downstream of the aerosol generating substrate.

13. The aerosol generating article according to claim 12, wherein the deformable capsule is positioned upstream of the mouth end.

14. The aerosol generating article according to claim 1, further comprising a vapour cooling element positioned in the wrapper downstream of the aerosol generating substrate and the deformable capsule is positioned downstream of the vapour cooling element.

15. The aerosol generating article according to claim 14, wherein the vapour cooling element comprises a hollow paper tube having a thickness which is greater than a thickness of the wrapper.

16. The aerosol generating article according to claim 1, wherein the airflow barrier cross-sectional area is between 98% and 100% of the cross-sectional area of the airflow channel.

17. The aerosol generating article according to claim 1, wherein the airflow barrier cross-sectional area is 100% of the cross-sectional area of the airflow channel.

18. An aerosol generating system comprising:

the aerosol generating article according to claim 1; and an aerosol generating device including: a crushing tool configured to allow a user to apply a force to the deformable capsule to permit deformation of the deformable capsule by the user from the undeformed state into the deformed state; and a heater for heating the aerosol generating substrate to generate an aerosol for inhalation by a user.

19. The aerosol generating system according to claim 18, wherein the crushing tool comprises a user-operable lever and an associated crushing plate, the user-operable lever is pivotally mounted on a device body of the aerosol generating device and is movable between a first position and a second position, and upon user operation to move the user-operable lever from the first position to the second position, the crushing plate is movable from a retracted position to an advanced position in which the crushing plate compresses the deformable capsule.

* * * * *